United States Patent [19]

Gibson

[11] 4,087,934

[45] May 9, 1978

[54] GLIDER

[76] Inventor: Thomas P. Gibson, W67N851 Washington, Cedarburg, Wis. 53012

[21] Appl. No.: 757,896

[22] Filed: Jan. 10, 1977

[51] Int. Cl.[2] ..... A63H 27/14

[52] U.S. Cl. ..... 46/81

[58] Field of Search ..... 46/79, 81, 76 R, 74 R, 46/80, 76 A, 77, 78; 244/16, 13, 91

[56] References Cited

U.S. PATENT DOCUMENTS

| | | | |
|---|---|---|---|
| 2,896,370 | 7/1959 | DeWitt, Jr. | 46/79 |
| 3,063,191 | 11/1962 | Main | 46/79 |
| 3,858,349 | 1/1975 | McClendon | 46/76 |

*Primary Examiner*—Russell R. Kinsey

*Assistant Examiner*—Mickey Yu

*Attorney, Agent, or Firm*—Andrus, Sceales, Starke & Sawall

[57] ABSTRACT

Three integral plastic type elements are selectively and releasably interconnected to form a lightweight, sturdy hand-launched glider. A series of strengthening ribs are interconnected by plastic webs to form a fuselage and interconnected upstanding vertical stabilizer. Releasable connections rigidly retain a wing to the fuselage and a horizontal stabilizer to the vertical stabilizer. The wing provides a centrally located upstanding air-deflection surface upon its upper wing surface which provides a desirable flight characteristic. Selectively bendable control surfaces are formed with memory and function with the upstanding air-deflection surface.

5 Claims, 9 Drawing Figures

GLIDER

BACKGROUND OF THE INVENTION

This invention relates to a glider.

Many different types of gliders have been designed and utilized to provide entertainment in the form of toys. Gliders made of lightweight wood or the like frequently have a limited useful life because of damage in use or from structural fatigue due to movement of members or parts thereof. Some glider constructions have attempted to increase the strength thereof by bonding plastic upon the lateral sides of a wood core, such as illustrated in U.S. Pat. No. 3,945,147.

Some gliders as illustrated in U.S. Pat. No. 2,896,370 have employed lips or spars or ribs in connection with a relatively thin sheet of plastic to provide strengthening for the structure. Other glider constructions have suggested using a single sheet of plastic formed by a vacuum forming process or gluing separate elements together to form an integral structure and which employ selectively bendable control surfaces, such as in U.S. Pat. Nos. 3,733,737 and 3,619,937.

Glider constructions have frequently utilized component parts which are assembled before using the glider. Some glider proposals have suggested a swept wing employing a rear notch and an abutting forward surface engaged within a fuselage slot with bonding tape maintaining the interconnection, as in U.S. Pat. No. 3,945,147.

Other gliders have employed movable interconnections between a wing and fuselage to permit adjustment for various flight characteristics, such as suggested in the U.S. Pat. No. 2,896,370.

SUMMARY OF THE INVENTION

The invention relates to a glider and particularly of the type displaying a desirable flight characteristic.

In one aspect of the invention, a fuselage provides a longitudinal axis substantially parallel to the direction of flight while the wing structure is connected to the fuselage and extends in opposite directions transverse to the longitudinal fuselage axis. The wing structure provides an air-deflecting ridge located upon an upper wing surface between points adjacent to oppositely disposed outer wing extremities. The air-deflecting ridge is located at a central wing portion between the front and rear wing edges and provides a desirable flight characteristic for the glider.

The wing construction includes a substantially continuous or flat bottom surface while the air-deflecting ridge is spaced from the forward and rear wing edges by a substantially continuous or flat surface. The air-deflecting ridge provides a forwardly facing slope of approximately 30° and a rearwardly facing slope of approximately 60° to provide the desired flight characteristics.

A pair of ailerons are formed in the rear portion of the wing surface and are selectively bendable to a predetermined position and retain such position with memory for functioning with the air-deflecting ridge to provide a desirable flight characteristic.

In another aspect of the invention, the glider provides a removable connection between supporting structure providing a wing retaining slot and a wing. When assembled, a central wing portion is located within the wing retaining slot so that the wing extends in opposite directions transverse to the supporting structure. The removable connection includes a first locking assembly including a part of the wing and a part of the supporting structure adjacent the wing retaining slot. The first locking assembly removably retains a first wing portion within a first retaining slot portion. A second locking assembly includes a part of the wing and a part of the supporting structure adjacent the wing retaining slot. The second locking assembly removably retains a second wing portion within a second retaining slot portion. The first and second locking assemblies rigidly maintain a removable connection between the supporting structure and the wing.

In a preferred form of the invention, the fuselage contains the longitudinal wing slot which, in turn, provides a forward edge spaced from a rearward edge adjacent a wing locking tab. The fuselage also includes a side edge adjacent the wing slot which provides a wing securing web. With such construction, a central portion of the forward wing edge snugly engages the forward slot edge. The rear wing edge provides a locking slot which removably engages the wing locking tab. The upper wing surface provides a pair of upwardly extending dimples which are located on each side of the wing securing web and removably retain the interconnection between the fuselage and the wing structure.

In another aspect, a vertical stabilizer extends upwardly from a tail end of the fuselage and provides an axially extended stabilizer slot located at an upper portion thereof. The stabilizer slot provides a first end forming a stabilizer locking tab which is spaced from a second open end permitting external access. A horizontal stabilizer forms a second wing surface and provides a first edge providing a locking slot which removably engages the vertical stabilizer locking tab. The horizontal stabilizer also includes an opening which removably engages or surrounds a retaining tab provided by the vertical stabilizer which is located adjacently to the open slot end. A pair of upwardly extending dimples upon the upper surface of the horizontal stabilizer are spaced on opposite sides of the locking edge provided by a side edge adjacent the stabilizer slot with such construction removably retaining the interconnection between the vertical and horizontal stabilizers.

In another aspect, the wing structure, vertical stabilizer and horizontal stabilizer are formed of plastic materials and each contains at least first and second laterally spaced parallel cuts extending from a rearward edge into the structure by a predetermined distance to define control surfaces, which are selectively bendable in a direction transverse to the longitudinal axis. The use of plastic type material permits the control surfaces to be bent to predetermined positions and remain thereat because of the memory provided by the plastic type material. It has been found that the particular location of such control surfaces provide a desirable flight characteristic particularly when used with the air-deflecting ridge provided by the wing structure.

The invention has been found to be useful as a toy, and to illustrate desirable flight characteristics in a glider construction.

BRIEF DESCRIPTION OF THE DRAWINGS

The drawings furnished herewith illustrate a preferred construction of the present invention in which the above advantages and features are clearly disclosed, as well as others which will be clear from the following description.

In the drawings.

DESCRIPTION OF THE PREFERRED ILLUSTRATED EMBODIMENT

Figure 1:
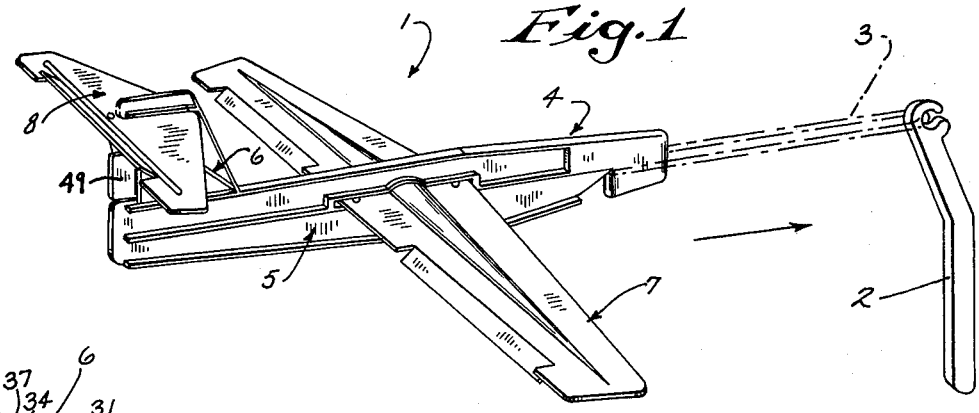
FIG. 1 is a perspective view of a hand launch glider coupled to a launching apparatus.

Referring to the drawings and particularly FIG. 1, a hand launched glider 1 is removably connected to a hand launcher 2 through an elastic band such as at 3.

The glider 1 includes an integral plastic type element 4 including a fuselage 5 and a vertical stabilizer 6. An integral plastic type element forming a wing 7 is removably connected to the fuselage 5 while an integral plastic type element forming a horizontal stabilizer 8 is removably connected to the vertical stabilizer 6.

Figure 2:
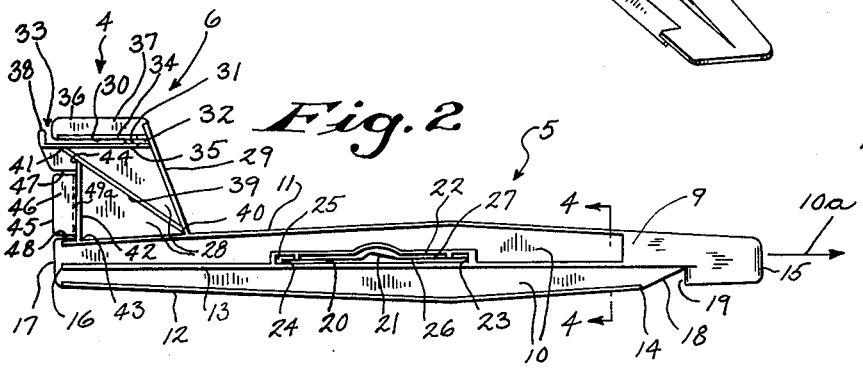
FIG. 2 is a side elevational view of an integral plastic element of FIG. 1 including a fuselage and a vertical stabilizer.
Figure 3:
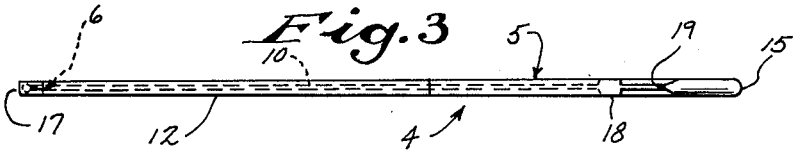
FIG. 3 is a plan view of the plastic element of FIG. 2.
Figure 4:
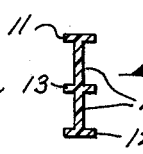
FIG. 4 is a cross-sectional view taken along the lines 4 — 4 of FIG. 2.
Figure 6:
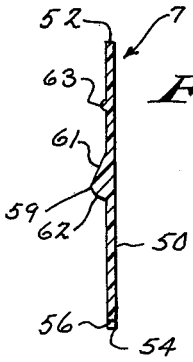
FIG. 6 is a cross-sectional view taken along the lines 6 — 6 in FIG. 5.
Figure 5:
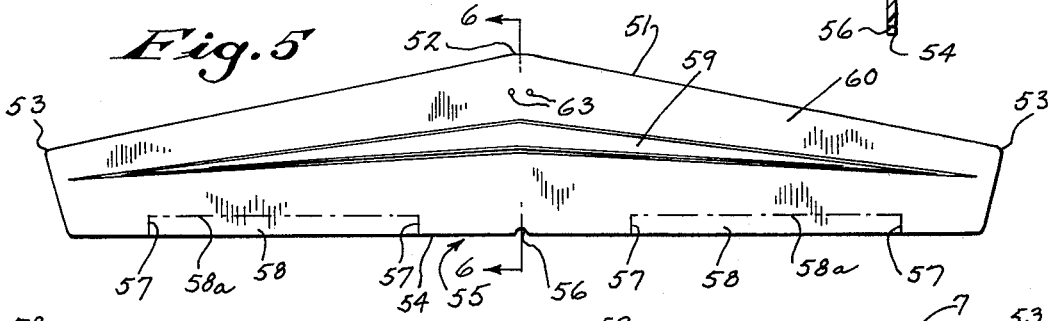
FIG. 5 is a plan view of another integral plastic element of FIG. 1 forming a wing.
Figure 7:
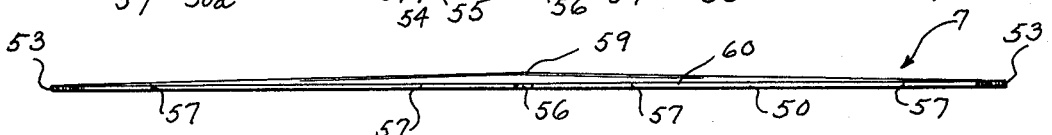
FIG. 7 is a rear elevational view of the wing of FIG. 5.
Figure 8:
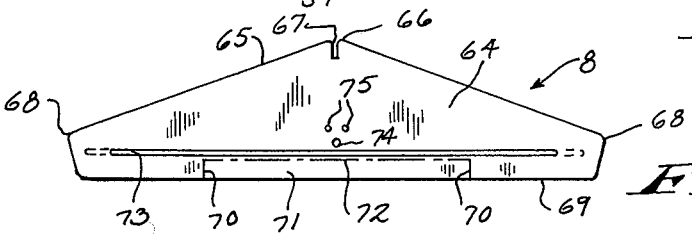
FIG. 8 is a plan view of another integral plastic element of FIG. 1 forming a horizontal stabilizer.
Figure 9:
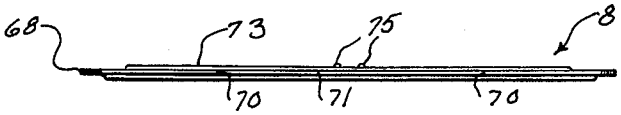
FIG. 9 is a rear elevational view of the horizontal stabilizer of FIG. 8.

With specific reference to FIGS. 2 – 4, the fuselage 5 is provided with an elongated body portion 9 having a longitudinal axis 10*a* substantially parallel to the direction of flight. The body portion 9 includes a sheet-like web 10 having a first predetermined thickness in a direction transverse to the longitudinal axis 10*a*. A series of vertically spaced strengthening ribs 11, 12 and 13 extend longitudinally from a forward location near 14 adjacent a nose end 15 to a rearward location near 16 adjacent a tail end 17 of the fuselage 5. The strengthening ribs 11, 12 and 13 have a second predetermined thickness which is greater than the first thickness of the web 10 as measured in a direction transverse to the longitudinal axis 10*a*. The rib 11 is located along an upper edge of the body portion 9 while rib 12 is located along a lower edge thereof. A rib 13 is centrally located within the body portion 9 and is interconnected to the ribs 11 and 12 through the sheet-like web 10.

The nose end 15 is provided with a thickness which is greater than the thickness of the web 10 and is substantially of the thickness as provided by the strengthening ribs 11, 12 and 13 as measured in a direction transverse to the longitudinal axis 10*a*. The substantial thickness provided by the nose 15 has been found to improve the flying capability of the glider 1. A notch 18 is located between rib 12 and the nose end 15 and provides a lip 19 for engagement with the rubber band 3.

The fuselage body portion 9 includes an axially extending slot 20 located above and immediately adjacent to the rib 13. Slot 20 is centrally located in the longitudinal direction of the fuselage 5 and is therefore spaced from the nose 15 and tail 17. Slot 20 includes a centrally located, upwardly directed notch 21. A reinforcing rib 22 having a thickness substantially equal to the ribs 11, 12 and 13 is located adjacent slot 20 and engages rib 13 to form a ribbed enclosure about slot 20. The reinforcing rib 22 abuts a forward edge 23 of slot 20 and is spaced from a rearward edge 24 of slot 20 by a portion 25 of web 10, thereby forming a wing locking tab. An upper slot edge 26 is spaced from the reinforcing rib 22 by a portion 27 of the sheet-like web 10 thereby forming a wing securing web.

The vertical stabilizer 6 extends upwardly from the tail end 17 and includes a sheet-like web 28 having a thickness substantially equal to web 10. The stabilizer 6 includes an upwardly extending strengthening rib 29 located along a forward edge of the vertical stabilizer 6. The rib 29 diminishes in thickness in an upward direction and engages rib 11 provided by fuselage 5.

A stabilizer slot 30 extends in an axial direction and is located at an upper portion of the vertical stabilizer 6. Slot 30 provides a first end 31 spaced adjacent to the upwardly extending rib 29 through a web portion 32 forming a stabilizer locking tab. A second end 33 of slot 30 is open to permit external access. A strengthening rib 34 is located along an upper portion of slot 30 while a substantially parallel rib 35 is located along the lower edge of slot 30. The upper rib 34 is spaced from an upper edge 36 of stabilizer 6 by an upper web portion 37. Such construction permits the unrestrained movement of web portion 37 and upper rib 34 in a direction transverse to the longitudinal axis 10*a*. The lower rib 35 provides an upwardly extending peg 38 located at a rearward portion thereof and spaced to the rear of rib 34 in the vicinity of the access opening 33.

A diagonal reinforcing rib 39 extends from a point 40 adjacent the intersection of ribs 11 and 29 to a rearward portion 41 of rib 35. An upwardly extending rib 42 extends from a rearward portion 43 of rib 11 to an upward portion 44 of the diagonal rib 39. Ribs 39 and 42 are constructed of a predetermined thickness which is greater than the thickness of web 28 but less than the thickness of ribs 11, 12 and 13. The rib 42 is spaced from a rear edge 45 of the vertical stabilizer 6 and connected through a web portion 46. Two vertically spaced cuts 47 and 48 extend in an axial direction from the rear edge 45 to the upwardly extending rib 42 to provide a rudder 49 therebetween. The rudder 49 is selectively bendable along a fold line 49*a* in a direction transverse to the longitudinal axis 10*a* and retains such bent position until selectively transversely moved to a different position.

The wing 7 is removably retained within the fuselage slot 20. The wing includes a sheet-like web having a substantially flat bottom surface 50 and generally contains a thickness substantially equal to the thickness of the web 10. The wing 7 provides a forward edge 51 having a central portion 52 which snugly engages the reinforcing rib 22 at the forward edge 23 of the fuselage slot 20. The forward edge 51 diverges rearwardly from the central portion 52 toward the outer extremities 53 to form a swept wing configuration. A rear edge 54 is located substantially normal to the fuselage 5 and includes a central portion 55 providing a locking slot 56 which removably engages the wing locking tab 25 of the fuselage 5.

The rear wing edge 54 contains two pairs of laterally spaced parallel cuts 57 extending forwardly by a predetermined distance into the wing with each pair on a respective side of the fuselage 5. The lateral cuts 57 form a pair of ailerons 58 which are capable of selective bending along fold lines 58*a* in a direction transverse to the longitudinal axis 10*a*. The ailerons 58 retain their bent position until selectively transversely moved to a different position and therefore provide inherent memory because of the nature of the plastic construction involved.

An air-deflecting ridge 59 is removably located within the notch 21 provided by the fuselage slot 20. The ridge 59 is located upon an upper surface 60 of wing 7 and extends substantially between the opposite disposed outer wing extremities 53. Specifically, the ridge 59 is located substantially centrally between the forward and rear wing edges 51 and 54 and is substantially parallel with the forward wing edge 51. The air-deflecting ridge 59 provides a forwardly facing slope 61 of approximately 30° and a rearwardly facing slope 62 of approximately 60° with such construction permitting a desired flight characteristic.

A pair of upwardly extending dimples 63 are located on wing 7 between the air-deflecting ridge 59 and the forward wing edge 51. The dimples are spaced transversely to the longitudinal axis 10*a* on opposite sides of the fuselage 5 and retain the wing securing web 27 therebetween.

The horizontal stabilizer 8 is removably retained within the notch 30 provided by the vertical stabilizer 6. The stabilizer 8 includes a sheet-like web 64 having a thickness substantially equal to the web 10. The stabilizer 8 includes a forward edge 65 having a central portion 66 containing a locking slot 67. The slot 67 removably engages the stabilizer locking tab 32 provided by stabilizer 6 while the forward stabilizer edge 65 diverges rearwardly from the central portion 66 toward a pair of outer extremities 68 thereby forming a swept wing configuration. A rear edge 69 is positioned substantially normal to the vertical stabilizer 6. A pair of laterally spaced parallel cuts 70 extending forwardly from the rear edge 69 by a predetermined distance into the horizontal stabilizer 8 thereby defining a control surface 71 which is selectively bendable during a fold line 72 in a direction transverse to the longitudinal axis 10*a*. Because of the nature of the plastic construction thereof, the control surface 71 retains its bent position. The horizontal stabilizer 8 includes a stiffening rib 73 located adjacent the control surface 71 and extends between points located adjacent the oppositely disposed ends 68. The horizontal stabilizer 8 provides an opening or hole 74 which removably engages or surrounds the upwardly extending peg 38 provided by the vertical stabilizer 6. A pair of upwardly extending dimples 75 are located on the upper surface of stabilizer 8 and on opposite sides of the rib 34 and upper web portion 37.

The special rib construction in combination with the interconnecting webs made of plastic or similar type materials provide a light-weight and durable glider. The removable interconnection of the integral plastic type elements 7 and 8 with the integral plastic type element 4 permits repetitious assembly and disassembly without damage for convenience in merchandising and storing.

The special interconnections not only permit repetitious assembly and disassembly, but also maintain the assembled glider in a substantially rigid and workable condition while in use. In this regard, the wing 7 may be assembled to the fuselage 5 by its ready insertion into the slot 20. The air-deflecting ridge 59 is located within the notch 21 while the forward central portion 52 firmly engages the strengthening rib 22 at the forward edge 23 of slot 20. The locking slot 56 engages the wing locking tab 24 provided at the rearward edge of slot 20. The swept wing configuration of the forward surface 51 permits the wing to be inserted into slot 20 at an angle to initially engage slot 56 with the locking tab 25 and thereafter pivot to become substantially normal to the fuselage 5 as when the forward central wing portion 52 engages the forward slot edge 23. In such position, the dimples 63 are located on opposite sides of the wing securing web 27 and function to retain the assembled relationship between the wing 7 and the fuselage 5. The wing may be readily disassembled by rotating the forward central portion 52 in a lateral direction away from the fuselage 5 to disengage the dimples 63 from the wing securing web 27. After sufficient rotation, the wing 7 may be moved slightly forward to disengage slot 56 from the locking tab 25.

The horizontal stabilizer 8 may also be easily assembled and disassembled from the vertical stabilizer 6. In assembly, the horizontal stabilizer 8 is selectively inserted within the slot 30. To facilitate entry therein, the upper web portion 37 and upper rib 34 are laterally bent to permit added accessibility to the slot 30. The horizontal stabilizer 8 is moved forwardly within slot 30 until the slot 67 engages the stabilizer locking tab 32. When in such position, the opening 74 is in a position to engage or surround the upwardly extending peg 38 to thereby form a releasable lock. The pair of dimples 75 are located on opposite sides of the rib 34 to maintain a rigid interconnection and construction.

The air-deflecting ridge 59 located upon and upper surface of wing 7 has been found to provide a desirable flight characteristics. Such characteristics are enhanced by the employment of selectively bendable ailerons 58, rudder 49 and control surface 71 which retain their bent positions because of memory provided by the plastic construction thereof.

The invention provides a unique light-weight design which displays substantial strength and durability while providing desirable flight characteristics.

Various modes of carrying out the invention are contemplated as being within the scope of the following claims, particularly pointing out and distinctly claiming the subject matter which is regarded as the invention.

I claim:

1. A glider, comprising a fuselage having a longitudinal axis substantially parallel to the direction of flight and a longitudinal wing slot having a forward edge spaced from a rearward edge providing a wing locking tab and an adjacent slot side edge providing a wing securing web, and a wing structure connected to said fuselage and extending in opposite directions transverse to said longitudinal fuselage axis and providing an air deflecting ridge located upon an upper wing surface between points adjacent to oppositely disposed outer wing extremities and within a central wing portion located between a forward wing edge and a rearward wing edge and providing a desirable flight characteristic for said glider, said forward wing edge having a central portion snugly engaging said forward slot edge and said rear wing edge providing a locking slot removably engaging said wing locking tab and said upper wing surface providing a pair of upwardly extending dimples each located on an opposite side of said wing securing web and removably retaining the interconnection between said fuselage and said wing structure.

2. A glider, comprising a fuselage having a longitudinal axis substantially parallel to the direction of flight and a vertical stabilizer extending upwardly from a tail end of said fuselage and providing an axially extending stabilizer slot located at an upper portion thereof, said stabilizer slot having a first end forming a stabilizer locking tab spaced from a second open end permitting external access and a side edge providing a locking edge and a retaining peg spaced adjacently to said open end, a wing structure connected to said fuselage and extending in opposite directions transverse to said longitudinal fuselage axis and providing an air deflecting ridge located upon an upper wing surface between points adjacent to oppositely disposed outer wing extremities and within a central wing portion located between a forward wing edge and a rearward wing edge, and a horizontal stabilizer forming a second wing surface having a first edge providing a locking slot removably engaging said stabilizer locking tab and an opening removably engaging said retaining peg and a pair of upwardly extending dimples spaced on opposite sides of said locking edge and removably retaining the interconnection between said vertical and horizontal stabilizers and providing a desirable flight characteristic for said glider.

3. A glider, comprising means providing a supporting structure for a wing and including a wing retaining slot, said wing having a central portion located within said wing retaining slot and extending in opposite directions transverse to said supporting structure means, first locking means forming a part of said wing and said supporting structure adjacent said wing retaining slot and removably retaining a first wing portion within a first retaining slot portion, said first locking means including a first edge of said wing central portion snugly engaging a first end of said retaining slot and said wing surface containing a pair of spaced outwardly extending dimples spaced from said first wing edge and confining a side edge of said retaining slot, and second locking means forming a part of said wing and said supporting structure adjacent said wing retaining slot and removably retaining a second wing portion within a second retaining slot portion, said second locking means including a second edge of said wing central portion providing a locking slot removably engaging a second end of said retaining slot oppositely disposed from said first slot end, said first and second locking means rigidly retaining the removable connection between the supporting structure means and said wing.

4. A glider, comprising means providing a supporting structure for a wing and including a wing retaining slot, said wing having a central portion located within said wing retaining slot and extending in opposite directions transverse to said supporting structure means, first locking means forming a part of said wing and said supporting structure adjacent said wing retaining slot and removably retaining a first wing portion within a first retaining slot portion, said first locking means including a hole located adjacent a first edge of said wing central portion removably surrounding a peg provided by said supporting structure means located adjacent a first end of said retaining slot and a pair of spaced outwardly extending dimples spaced from said first wing edge and confining a side edge of said retaining slot, and second locking means forming a part of said wing and said supporting structure adjacent said wing retaining slot and removably retaining a second wing portion within a second retaining slot portion, said second locking means including a second edge of said wing central portion providing a locking slot removably engaging a second end of said retaining slot oppositely disposed from said first retaining slot end, said first and second locking means rigidly retaining the removable connection between the supporting structure means and said wing.

5. A hand launch glider, comprising a first integral plastic type element including a fuselage with an elongated body portion having a longitudinal axis substantially parallel to the direction of flight and including a sheet-like web with a first predetermined thickness in a direction transverse to said longitudinal axis and first, second and third vertically spaced strengthening ribs longitudinally extending from a point adjacent a nose end of said fuselage to a point adjacent a tail end of said fuselage and having a second predetermined thickness greater than said first thickness in a direction transverse to said longitudinal axis, said first rib located along an upper edge of said body portion, said second rib located along a lower edge of said body portion, and said third rib centrally located within said body portion and connected to said first and second ribs through said sheet-like web, said nose end having a thickness greater than said first thickness and substantially equal to said second thickness in a direction transverse to said longitudinal axis thereby providing weight to said nose end to improve flying capability, and a notch located between said second strengthening rib and said third thickness for removable engagement with a launcher, said fuselage body portion including an axially extending slot located above and immediately adjacent said third rib and centrally in the longitudinal direction of said fuselage and spaced from said nose and tail ends, said slot having a centrally located upwardly directed notch, a reinforcing rib having a thickness substantially equal to said second thickness and located adjacent said slot and engaging said third rib so that said reinforcing and third ribs surround said slot, said reinforcing rib abutting a forward edge of said slot and spaced from a rearward edge of said slot through a portion of said sheet-like web forming a wing locking tab, said upper slot edge spaced from said reinforcing rib by another portion of said sheet-like web forming a wing securing web, a vertical stabilizer extending upwardly from said tail end and including a sheet-like web having a thickness substantially equal to said first thickness and an upwardly extending strengthening rib having an upwardly diminishing thickness located along the forward edge of said vertical stabilizer and engaging said first longitudinally extending strengthening rib provided by said fuselage, an axially extending stabilizer slot located at an upper portion of said vertical stabilizer having a first end spaced adjacent to said upwardly extending rib through a portion of said sheet-like web forming a stabilizer locking tab and a second open end permitting external access, said longitudinal side edges of said stabilizer slot containing fourth and fifth substantially parallel strengthening ribs having a thickness substantially equal to said second thickness with said fourth rib located along the upper portion of said stabilizer slot and spaced from an upper edge of said vertical stabilizer through an upper portion of said web thereby permitting the unrestrained fourth rib and upper web portion to be selectively bent in a direction transverse to said longitudinal axis, said fifth rib located along the lower portion of said stabilizer slot and including an upwardly extending peg located on a rearward end of said fifth rib and spaced rearwardly from said fourth rib and upper web portion, a diagonal reinforcing rib having a third predetermined thickness greater than said first thickness and less than said second thickness and extending from a point adjacent the intersection of said upwardly extending rib and said first rib to a rearward portion of said fifth rib and a second upwardly extending rib having a thickness substantially equal to said third thickness and extending from a rearward portion of said first rib to an upward portion of said diagonal rib and spaced from a rear edge of said vertical stabilizer by a rear portion of said web, said rear web portion having first and second vertically spaced cuts extending in a axial direction from said rear edge to said second upwardly extending rib and defining a rudder therebetween and selectively bendable in a direction transverse to said longitudinal axis and retaining said bent position until selectively transversely moved to a different position, a second integral plastic type element forming a wing removably retained within said fuselage slot and including a sheet-like web having a substantially flat bottom surface and a thickness substantially equal to said first thickness, said wing providing a forward edge having a central portion snugly engaging said reinforcing rib at the forward edge of said fuselage slot and diverging rearwardly toward the outer extremities of said wing to form a swept-wing conifguration and a rearward edge located substantially normal to said fuselage and including a central portion providing a locking slot removably engaging said wing locking tab of said fuselage, said rearward wing edge containing two pairs of laterally spaced parallel cuts extending forwardly by a predetermined distance into said wing on each side of said fuselage thereby defining a pair of ailerons selectively bendable in a direction transverse to said longitudinal axis and retaining said bent positions until selectively transversely moved to different positions, an air deflecting ridge located within said upwardly directed notch provided by said fuselage slot and extending substantially between the oppositely disposed outer wing extremities at an upper wing surface and located substantially centrally between said forward and rear wing edges and substantially parallel with said forward wing edge, said air deflecting ridge having a forwardly facing slope of approximately 30° and a rearwardly facing slope of approximately 60° for permitting a desired flight characteristic, said upper wing surface containing a pair of upwardly extending dimples located between said air deflecting ridge and forward wing edge and spaced transversely to said longitudinal axis on opposite sides of said fuselage and removably retaining said wing securing web; and a third integral plastic type element forming a horizontal stabilizer removably retained by said vertical stabilizer and including a sheet-like web having a thickness substantially equal to said first thickness and a forward edge with a central portion containing a locking slot removably engaging said stabilizer locking tab of said vertical stabilizer and diverging rearwardly toward the outer extremities of said horizontal stabilizer to form a swept-stabilizer configuration and a rearward edge located substantially normal to said vertical stabilizer, said rearward horizontal stabilizer edge containing a pair of laterally spaced parallel cuts extending forwardly by a predetermined distance into said horizontal stabilizer thereby defining a controlled surface selectively bendable in a direction transverse to said longitudinal axis and retaining said bent position until selectively transversely moved to a different position, said horizontal stabilizer having a stiffening rib located adjacent said controlled surface and extending between points located adjacent the oppositely disposed ends laterally spaced from said vertical stabilizer, said horizontal stabilizer containing an opening removably engaging said upwardly extending peg and a pair of upwardly extending dimples located adjacent on opposite sides of said fourth rib and upper web portion provided by said vertical stabilizer for removably retaining said horizontal stabilizer.

* * * * *